US006676313B1

(12) United States Patent
Kelley et al.

(10) Patent No.: US 6,676,313 B1
(45) Date of Patent: Jan. 13, 2004

(54) PRINTER MEDIA FEED ENCODER APPARATUS AND METHOD

(75) Inventors: Richard A. Kelley, Vancouver, WA (US); Bruce G. Johnson, Ridgefield, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/198,951

(22) Filed: Jul. 18, 2002

(51) Int. Cl.[7] ..... B41J 11/58; B41J 13/00

(52) U.S. Cl. ..... 400/582; 400/624; 400/634

(58) Field of Search ..... 400/582, 624, 400/634, 636, 636.1, 637.1; 271/270, 258.05, 258.01, 147

(56) References Cited

U.S. PATENT DOCUMENTS

| | | | |
|---|---|---|---|
| 4,157,822 | A | 6/1979 | Miller |
| 5,054,700 | A | 10/1991 | DeWitt |
| 5,826,157 | A | 10/1998 | Wierszewski |
| 6,298,778 | B1 | 10/2001 | Onodera et al. |

*Primary Examiner*—Charles H. Nolan, Jr.

(57) ABSTRACT

A printer with a media feed apparatus bas a media tray with a surface for supporting a media stack. A wave drive mechanism has a pair of wheels, a belt looped around said wheels, and a plurality of freewheeling rollers. Each one of the freewheeling rollers has an axis attached to and moving with the belt. At least one of the plurality of freewheeling rollers makes contact with the top sheet in the tray while the belt moves the axis in a feed direction to shift the top sheet in the feed direction. A controller controls a bias force of the wave drive mechanism against the top sheet during the time that the wave drive mechanism moves the sheet.

14 Claims, 1 Drawing Sheet

PRINTER MEDIA FEED ENCODER APPARATUS AND METHOD

FIELD OF THE INVENTION

This invention relates to computer printers, and particularly to feed mechanisms and methods for feeding media from a stack.

BACKGROUND AND SUMMARY OF THE INVENTION

For feeding media from a stack for sequential printing of sheets, it is necessary to individuate the sheets. This may be done by various means, including systems using friction to drag a top sheet from a stack to a media transport system and printing system. However, such systems relying on friction such as provided by rubber rollers can be unreliable as the surface of the roller wears. In addition, the rubbing effects can impair printed output, particularly for specialized coated media used for high quality photo reproduction.

One effective means to individuate a top sheet that is not subject to degradation from wear, and which does not rub on sheet surfaces is a "wave drive" system. Wave drive systems operate by repeatedly rolling a roller along the surface of the top sheet in a stack in a given direction. This shifts each upper sheet relative to the sheet on which it rests, with the shift being greatest at the top of the stack. With one sheet shifted laterally away from the others by an adequate margin, it encounters the nip of a pair of feed rollers, and is drawn individually from the stack.

The rolling effect relies on the inherent air space between and compressibility of the sheets, and involves no friction with or among the sheets, other than the minimal static friction of a freewheeling roller in contact with the top sheet surface. A wave drive mechanism typically has several rollers that each are moved about an oblong track over the sheets, so that motion on the lower run of the oblong is in a straight line while in contact with the sheet, and so that a next roller on the track contacts the sheet approximately when or before the prior roller departs the sheet to return via the upper track for another cycle. Each cycle shifts the top sheet slightly relative to the next sheet, and multiple cycles are required.

While effective for many applications, wave drive systems have a limitation for high speed printing. The speed of motion of the top sheet does not remain proportionate to the speed of operation of the wave drive mechanism over the course of printing a stack of media. Initially, with a thick stack, the significant compressibility of the stack makes the wave drive mechanism reasonably efficient, so that a sheet is moved at an adequately fast velocity for a given speed of drive operation (i.e. the velocity at which the axes of the rollers translate with respect to a fixed frame of reference.) However, as the stack becomes more depleted, the efficiency drops, and the rate of wave drive operation may limit printing speed. This occurs when, after a sheet is taken by the feed roller nip, the wave drive mechanism takes too much time to advance the next sheet to the nip, so that the leading edge of the next sheet lags excessively behind the trailing edge of the prior sheet, effectively reducing printer throughput rate.

Moreover, different sizes, types, and thicknesses of media respond differently to a wave drive mechanism, and each has a different function of feed efficiency versus stack height. Even if the characteristics of each type were known, and a separate program implemented to increase the speed of the wave drive mechanism, it would be impractical to look up and enter the media type for each job, even assuming that the user was aware of the need and remembered to do so. And if one selected a wave drive operation speed adequate to move the least efficient media type at a nearly depleted condition, the speed would be so high that the mechanism would generate unwanted noise, and be subject to needless premature wear or failure.

The present invention overcomes the limitations of the prior art by providing a printer with a media feed apparatus having a media tray with a surface for supporting a stack of media sheets. In a wave drive mechanism having a pair of wheels, a belt looped around the wheels, and a plurality of freewheeling rollers, each one of the freewheeling rollers has an axis attached to and moving with the belt. At least one of the plurality of freewheeling rollers makes contact with the top sheet in the tray while the belt moves the axis in a feed direction to shift the top sheet in the feed direction. A controller controls a bias force of the wave drive mechanism against the top sheet during the time that the wave drive mechanism moves the sheet.

DETAILED DESCRIPTION OF A PREFERRED EMBODIMENT

Figure 1:
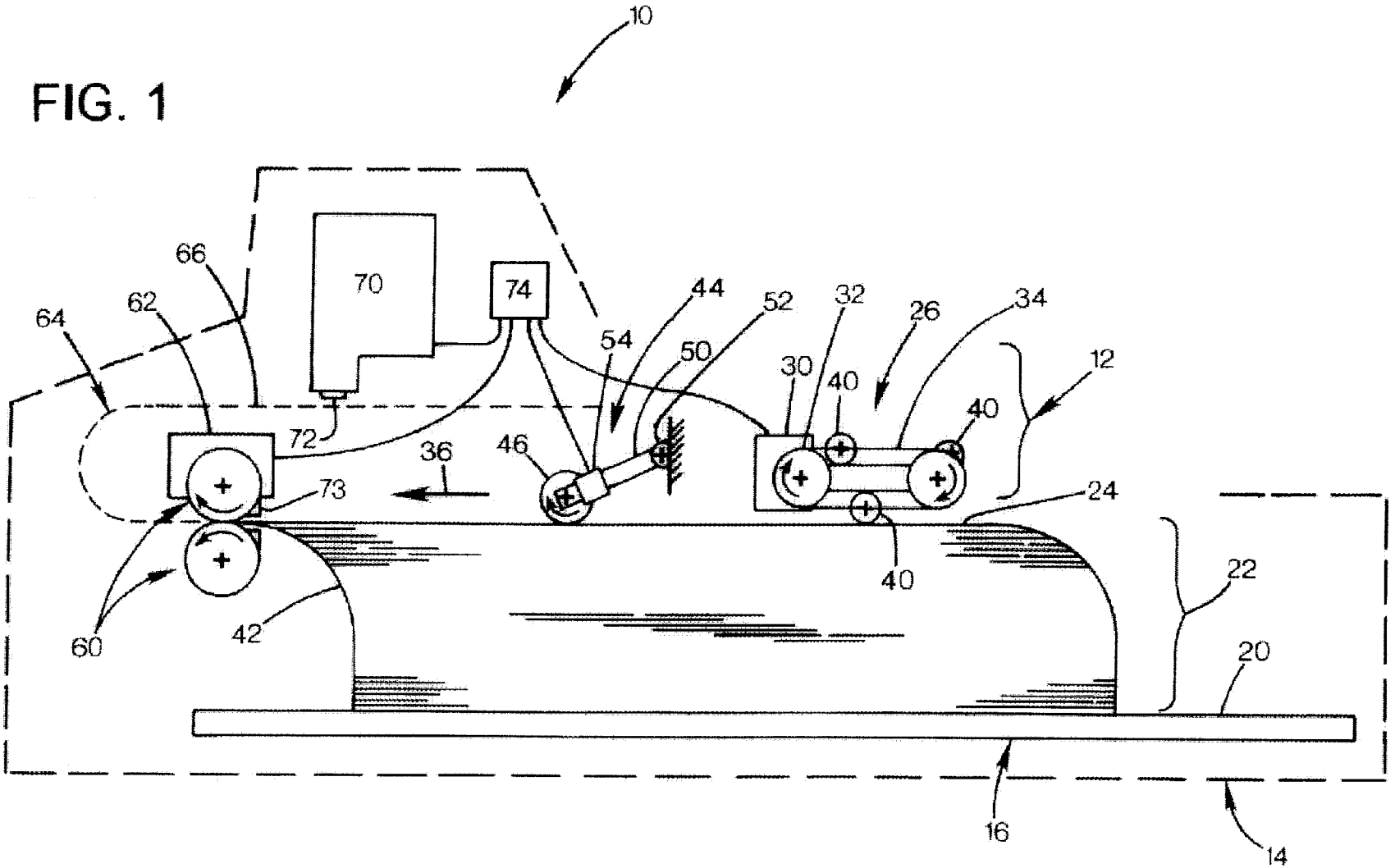
FIG. 1 is a simplified sectional side view of a printer according to a preferred embodiment of the invention.

FIG. 1 shows a printer 10 having a media transport system 12. The printer has a housing 14 that encloses the printer components, including a media supply tray 16. The tray has an upper media support surface 20 on which a stack of media 22 rests. A top sheet 24 on the stack has an upwardly facing surface. The tray may be upwardly movable as the stack is depleted, to maintain the topmost sheet in a common plane throughout operation.

The media transport includes a wave drive mechanism 26 positioned above and contacting the top sheet. The wave drive mechanism has a media contact element operable to make contact with a top sheet of a media stack in the tray while moving in a feed direction to shift the top sheet in the feed direction. An encoder above the tray operates to detect motion of the top sheet. In one embodiment a controller monitors the encoder to determine the speed of sheet motion, and sets the force which the media contact element applies against the top sheet to maintain the sheet motion above a threshold. In another embodiment the controller sets the speed of the wave drive mechanism to maintain the sheet motion above a threshold. Accordingly, the speed of the wave drive mechanism and/or the force applied by the contact element is controlled to maintain sheet motion above a threshold level.

The wave drive mechanism includes a motor 30 that drives one of a pair of spaced apart drive wheels 32 about which a belt or track 34 is looped. The drive wheels are oriented with axes parallel to each other and to the plane of the top sheet, and perpendicular to a feed direction 36 in which the sheets are intended to be fed to the printer. Several rollers 40 are mounted to the belt, with each roller freewheeling on its axis, and the axes of the rollers attached to the belt so that the rollers move with the belt. In the preferred embodiment, the rollers are biased gently against the top sheet, or the media stack is biased upward against the rollers. In some embodiments the bias force is varied by a controller 74. The rollers may extend the width of the sheets being moved, or may be of limited width, and effective to shift the sheets by contact at a median line of the sheets.

During operation, the wave drive motor 30 generates clockwise motion of the belt, and therefor lateral motion of a roller on the lower span of the belt in the feed direction 36. As the roller rolls over the top sheet in the manner of a rolling pin rolling over dough, each of several of the upper sheets shifts slightly in the feed direction relative to sheet on which it rests, with the shift amount being greater nearer the top sheet. This effect is not the result of rubbing or dragging, or any other mechanism in which the motion relies on the friction between an impeller and a sheet. As a result of repeated cycles of roller motion, the stack takes on the shape illustrated, with the feed-direction leading edges 42 taking on a concave shape, at least at the upper sheets, and with the curve generated by the edges being essentially asymptotic to the plane of the top sheet.

A sheet motion encoder 44 operates to record the position, motion, and or velocity of the top sheet, and/or to provide data to enable any other measurement to be determined. In the preferred embodiment, the encoder includes a wheel 46 connected to an arm 50 pivotally connected to a fixed portion of the printer at a mounting point 52 shown symbolically for clarity. In the preferred embodiment, the mounting location may be relocated or movable to accommodate different media sizes. The arm pivots to accommodate height variations in the stack, and is spring biased or gravity biased downward lightly against the top sheet adequately to ensure that the wheel rolls with the motion of the top sheet without sliding.

A sensor 54 is connected to the arm adjacent the wheel, and operates to convert motion of the wheel to a controlled series of electrical pulses or other signals. The wheel preferably includes optical markings or a pattern of transparent and opaque regions so that an emitter and detector on the sensor may detect incremental movement of the wheel, in the manner of numerous motion encoding devices such as computer mouse cursor control devices. The encoder may employ any alternative means of measuring surface movement including encoders with magnetic transducers, and direct optical surface measurement techniques.

The printer includes a pair of feed rollers 60 that define a nip in the plane of the top sheet, and parallel to a leading edge of the top sheet. The rollers either extend the width of the sheet, or are provided by a set of narrower opposed wheels distributed along the sheet width, to provide non-skewing motion of a sheet that is inserted into the nip while the rollers are moving. A feed roller motor 62 is connected to one of the feed rollers to provide controlled rotation. The feed rollers operate to receive the top sheet of the stack, after the wave drive mechanism has operated sufficiently to shift the top sheet into the nip. By this time, the top sheet will have advanced adequately beyond the sheet upon which it rests, so that only the top sheet is drawn from the stack by the feed rollers. Preferably, the shift distance differential between the top sheet and the next sheet is adequate to ensure that the second sheet is not also picked from the stack.

The feed rollers advance the top sheet along a paper path 64 that articulates back in the opposite direction from the stack feed direction to a flat printing plane 66 parallel to the top sheet plane. An ink jet pen 70 having a print head 72 reciprocates just above the printing plane on a scan axis perpendicular to a feed axis defined by the feed direction, end expels ink droplets while scanning to generate swaths of printing. The feed rollers may provide the impetus to increment the sheet during printing, or another drive mechanism (not shown) may provide the needed controlled motion, with the feed rollers simply providing the motion to transfer the sheet from the stack to the drive mechanism. An edge sensor 73 adjacent the inlet side of the feed roller nip detects the presence of a top sheet that has nearly advanced to the point where it will be picked by the feed rollers.

Control circuitry in a controller 74 is connected to all electronic components of the printer to control all aspects of printing and media handling. Connections to the encoder 44, wave drive 26, feed roller motor 62, and edge sensor 73 enable control of the media feed system. The controller operates to monitor the encoder to determine the velocity of the top sheet, establishes the speed and/or force of operation of the wave drive mechanism, determines whether a sheet is close enough to the feed roller nip to break an optical beam of the edge detector, and controls the rotation of the feed rollers. The controller is also connected to a computer of other device from which printing data and other commands are normally received.

During normal operation, the controller sets the wave driver at a nominal speed, and monitors the encoder to determine whether the top sheet is moving at a suitable velocity, If the velocity is below a pre-established threshold, the controller increases the wave drive speed until the sheet velocity is above the threshold. In an alternative embodiment the controller 74 instead increases the bias force of the wave drive 26 against the sheet. In still another embodiment the controller 74 increases either one or both of the bias force and speed of the wave drive 26. Normally, for relatively tall stacks of media, and for media like standard paper that responds readily to the wave drive mechanism, a nominal wave drive force and speed will be more than adequate to advance the sheet to trigger the edge sensor before the feed rollers are ready to pick the sheet.

The first sheet is readied for picking with advancing by the wave drive to trigger the edge detector. Then, the system waits until the sheet is needed for printing. When needed, the controller operates the wave drive while rotating the feed rollers, to advance the sheet the short distance until it is picked by the nip, whereby the sheet may advance at a faster rate that provided by the wave drive. Upon this, the encoder will register a rapid increase in the sheet velocity, indicating to the controller that the sheet has been picked, and that operation of the wave drive may be stopped. Alternatively, or as a supplement, the sensor 73 may also trigger the rollers, and thereupon trigger a stoppage of the wave drive.

The wave drive operation should be stopped before or about at the time the trailing edge of the top sheet departs from a position where a wave drive roller may be contacting the sheet. This prevents further shifting of the next sheet into the nip, which would cause an unwanted double pick. As the first sheet is drawn by the feed rollers from the stack, the freely rolling roller or rollers in contact with the sheet's upper surface simply roll clockwise to allow the sheet to be drawn away. The limited biasing force between the wave drive and the stack limits friction between the top sheet and the underlying sheet. In alternative embodiment where such friction is a concern, the wave drive may be vertically movable in response to the controller to raise it to eliminate biasing force when stack shifting is not required. This option also permits continuous operation of the wave drive belt during printing.

As the first sheet is drawn from the stack by the feed rollers, it is fed to the print zone below the print head, after which motion of the sheet is in precise increments coordinated with the pen motion and printing action. As printing and feeding proceeds, the trailing edge of the sheet eventually passes the sensor 73, indicating that the trailing edge is nearly in the nip. The controller determines when the feed rollers have rotated an adequate distance that the first sheet is clear of the feed rollers (and presumably passed on to other feed mechanism for continued printing.) Upon this, the controller immediately readies the next sheet for feeding.

An important aspect of the invention is in making the next sheet ready within a limited time interval, so that the next sheet's leading edge may follow closely behind the prior sheet's training edge, improving throughput rates. To ready the next sheet, the controller operates the wave drive until the next sheet's leading edge interrupts the edge sensor. The wave drive is controlled to operate at sufficient speed and/or force to assure that the time to increment the sheet into this position is adequately rapid, as discussed above. Where printing occurs rapidly, and the wave drive is a limiting factor, the controller may establish that the wave feeding continue without pausing as the leading edge interrupts the edge sensor.

In the various embodiments the controller establishes the speed, the bias force or both the speed and bias force at which the wave drive is operated by any of several ways. It may analyze in real time a current ratio of sheet velocity to drive velocity to determine an efficiency ratio, and adjust the drive speed and/or bias force to maintain a suitable ratio above a preselected threshold. Or, it may monitor the time, interval required for a sheet to be advanced from the position it lies in when the sheet above is picked, to the position in which it is ready to be picked, and set the wave drive at a speed and/or force adequate to keep this time above a certain threshold. Similarly, it may determine the time or amount of wave drive operation required to advance a sheet from a paused position after it has interrupted the edge detector, until it is picked by the feed rollers (as established by a transient in velocity reported by the motion encoder. Any of these approaches my be enacted by gathering information from actions on a prior sheet, and changing parameters for the next sheet, on the principle that rapid changes are not expected from one sheet to the next in a stack of a multitude of sheets.

The above is intended to accommodate a wide range of media types such as conventional paper, coated paper, transparencies, and any other commercially available media. Thicknesses of media may range from 60 $gm/m^2$ to 271 $gm/m^2$.

While the above is discussed in terms of preferred and alternative embodiments, the invention is not intended to be so limited.

What is claimed is:

1. A printer with a media feed apparatus comprising:

a media tray having a support surface for supporting a media stack;

a feed roller for receiving a top sheet of the media stack;

a wave drive mechanism comprising a pair of wheels, a belt looped around said wheels, and a plurality of freewheeling rollers, each one of said freewheeling rollers having an axis attached to and moving with the belt, wherein at least one of the plurality of freewheeling rollers makes contact with the top sheet in the tray while the belt moves said axis in a feed direction to shift the top sheet in the feed direction; and a controller controlling a bias force of the wave drive mechanism against the top sheet during said time that the wave drive mechanism moves the sheet.

2. A printer according to claim 1, further comprising:

a sensor which detects motion of the top sheet within the tray at least during a time that the wave drive mechanism moves the sheet in the feed direction prior to the sheet being received by the feed roller; and wherein the controller is coupled to the sensor and the wave drive mechanism.

3. A printer according to claim 1, wherein there is essentially no motion-motivating friction between the top sheet and said at least one of the plurality of freewheeling rollers.

4. A printer according to claim 2, wherein the controller is operable to increase the bias force of the wave drive mechanism in response to a detection by the sensor indicating that a velocity of the top sheet is less than a preselected threshold.

5. A printer according to claim 1, the controller is operable to maintain a rate of sheet movement by controlling the bias force of the wave drive mechanism.

6. A printer according to claim 1, the controller is operable to maintain a rate of sheet movement by controlling operating speed and bias force of the wave drive mechanism.

7. A method of individuating a top sheet from a stack of media comprising:

shifting the top sheet in a feed direction with a wave guide mechanism to move the top sheet into a position to be picked from the media stack, wherein the wave guide mechanism comprises a pair of spaced apart wheels, a belt looped around the wheels, and a plurality of freewheeling rollers, each one of said freewheeling rollers having an axis attached to and moving with the belt, wherein at least one of the plurality of rollers makes contact with the top sheet while the belt moves the axis of said at least one freewheeling roller;

picking the top sheet from the media stack;

monitoring the motion of the sheet during shifting prior to picking; and in response to monitoring, controlling a bias force of the wave drive mechanism against the top sheet to maintain a rate of movement of the sheet above a preselected threshold during said shifting.

8. A method according to claim 7, wherein controlling a bias force includes determining a ratio of a rate of sheet advance to bias force, and increasing the bias force as the ratio decreases.

9. A method according to claim 7, wherein the controller is operable to increase the bias force of the wave drive mechanism in response to a detection by the sensor indicating that a velocity of the top sheet is less than a preselected threshold.

10. A method according to claim 7, wherein the controller is operable to increase operating speed and bias force of the wave drive mechanism in response to a detection by the sensor indicating that a velocity of the top sheet is less than a preselected threshold.

11. A media sheet feed apparatus comprising:

a media tray having an upper media stack support surface suitable for supporting a stack of media;

a wave drive mechanism comprising a pair of spaced apart wheels, a belt looped around the spaced apart wheels, and a plurality of freewheeling rollers, each one of said freewheeling rollers having an axis attached to and moving with the belt, wherein at least one of the plurality of freewheeling rollers makes contact with the stack while the belt moves the axis of said at least one freewheeling roller in a feed direction to shift a current top sheet of the stack into a position to be picked from the media stack;

a picking mechanism which picks the shifted top sheet;

a motion encoder above the tray operable to detect motion of the top sheet at least during a time while the wave drive mechanism moves the sheet prior to the sheet being picked by the picking mechanism; and a controller connected to the encoder and the wave drive mechanism, and operable to maintain a rate of sheet movement, while the sheet is being shifted, above a preselected threshold prior to said picking by increasing the bias force of the wave drive mechanism.

12. An apparatus according to claim 11, wherein the controller is operable to adjust the bias force of the wave drive mechanism to establish a selected speed of the top sheet.

13. An apparatus according to claim 11, wherein the controller is operable to adjust bias force and operating speed of the wave drive mechanism to establish a selected speed of the top sheet.

14. An apparatus according to claim 11, wherein the rate of sheet movement decreases as stack deformity decreases, the stack deformity decreasing when the stack nears depletion.

* * * * *